United States Patent [19]

Wakabayashi

[11] Patent Number: 4,542,698

[45] Date of Patent: Sep. 24, 1985

[54] POWER-AND-FREE TROLLEY CONVEYOR OF FLOOR TYPE

[75] Inventor: Takao Wakabayashi, Shinsenri-Minamimachi, Japan

[73] Assignee: Nakanishi Metal Works Co., Ltd., Tenmabashi, Japan

[21] Appl. No.: 521,592

[22] Filed: Aug. 9, 1983

[30] Foreign Application Priority Data

Aug. 10, 1982 [JP] Japan ..... 57-139563

[51] Int. Cl.[4] ..... B61B 10/00; B61B 13/12

[52] U.S. Cl. ..... 104/172 B; 104/130; 104/172 S; 104/250

[58] Field of Search ..... 104/96, 103, 130, 172 B, 104/172 S, 250

[56] References Cited

U.S. PATENT DOCUMENTS 4,461,216 7/1984 Carney ..... 104/172 B

FOREIGN PATENT DOCUMENTS 2132502 1/1973 Fed. Rep. of Germany ... 104/172 S 55-40145 3/1980 Japan ..... 104/172 B

*Primary Examiner*—Randolph A. Reese

*Attorney, Agent, or Firm*—Armstrong, Nikaido, Marmelstein & Kubovcik

[57] ABSTRACT

A power-and-free trolley conveyor comprising carriers adapted to run on a free line and each including a free trolley provided with a pair of opposite pivotable engaging dogs. Each of the engaging dogs has a downwardly projecting engaging projection and a disengaging wing. A power line is disposed immediately below the free line or toward one side thereof to bring a pusher dog on a power trolley into engagement with the engaging projection of at least one of the pair of engaging dogs, whereby the carrier is transferred to another line for joining or diversion.

4 Claims, 23 Drawing Figures

POWER-AND-FREE TROLLEY CONVEYOR OF FLOOR TYPE

BACKGROUND OF THE INVENTION

The present invention relates to a power-and-free trolley conveyor of the floor type.

With such trolley conveyors, power line discontinuous portions for joining together or diverting conveyor carriers are usually provided with a carrier propelling apparatus which is driven independently of the drive chain for power trolleys to transfer the carriers. However, installation of the carrier propelling apparatus involves the problem of necessitating a very high equipment cost. Further according to the conventional practice, a carrier stopping at the power line discontinuous portion is transferred by being pushed from behind with a pusher dog which is disengaged from the following carrier, but this method of transfer has the problem of generally taking time and being inefficient. Further at a distance before the carrier joining or diverting portion, the conveyor line to which carriers are to be transferred is usually provided with a stopper device which is generally adapted to disengage the pusher dog from the carrier on opposite sides of the conveyor line and which therefore has the problem of being large-sized and costly.

SUMMARY OF THE INVENTION

The object of the present invention is to provide a power-and-free trolley conveyor of the floor type which is free of the foregoing problems.

The trolley conveyor of the present invention is characterized in that a carrier adapted to run a free line comprises a free trolley provided with a pair of opposite pivotable engaging dogs, each of the engaging dogs having a downwardly projecting engaging projection and a disengaging wing, a power line being disposed immediately below the free line or toward one side thereof to bring a pusher dog on a power trolley into engagement with the engaging projection of at least one of the pair of engaging dogs, whereby the carrier is transferred to another line for joining or diversion.

With the conveyor of the present invention, carriers can be transferred to another line for joining or diversion very efficiently and reliably by an arrangement of simple construction and low equipment cost. Furthermore, the stopper device for stopping the carrier needs only to be provided at one side alone of the conveyor line and can therefore be very compact and low in equipment cost. Thus the present conveyor has various advantages.

DESCRIPTION OF THE PREFERRED EMBODIMENTS

Figure 2:
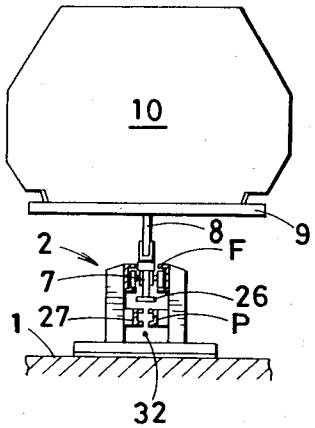
FIG. 2 is a view in section taken along the line II—II in FIG. 1.
Figure 1:
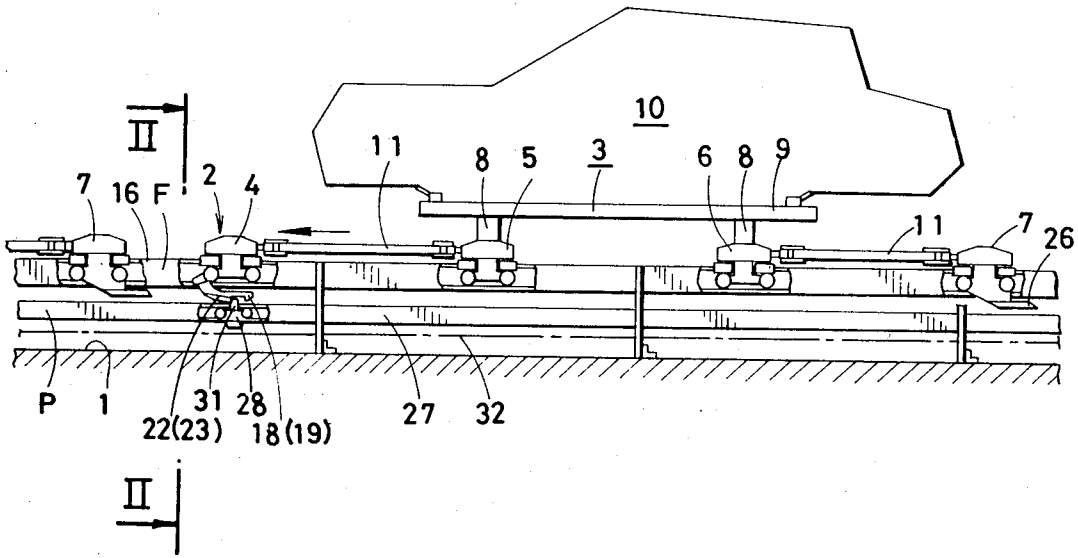
FIG. 1 is a side elevation partly broken away and showing a power-and-free trolley conveyor of the floor type according to the invention.

With reference to FIGS. 1 to 7, a free-and-power trolley conveyor 2 installed on a floor 1 has a free line F for guiding carriers 3 and a power line P coextensive with the line F therebelow. Each carrier 3 comprises four free trolleys 4, 5, 6 and 7. An article support 9 attached to the two intermediate free trolleys 5, 6 by vertical connecting bars 8, 8 is adapted to carry thereon an article 10 such as a motor vehicle in the course of assembly. The front free trolley 4 and the rear free trolley 7 are connected to the intermediate free trolleys 5, 6, respectively, by horizontal connecting bars 11, 11. Each of the free trolleys 4, 5, 6, 7 comprises a trolley main body 12, a pair of front and a pair of rear vertical rollers 13 mounted on the front and rear ends of the main body 12, a pair of front and rear horizontal rollers 14, and a connecting member 15 U-shaped in cross section and attached to the top of the main body 12 at its center. The free line F is provided by a pair of free rails 16 opposed to each other and each in the form of a channel member. The vertical rollers 13 of the free trolley are placed on the lower horizontal walls **16*a* of the free rails 16, and the horizontal rollers 14 are arranged between and guided by the upper horizontal walls 16*b* of the free rails 16**.

The front free trolley 4 has a pair of opposed brackets 17 projecting forward from its trolley main body 12 and provided with a pair of opposite pivotable engaging dogs 18, 19 at their front ends. The engaging dogs 18, 19 are supported by the same pivot 20 at portions thereof toward the front ends, have downwardly projecting engaging projections 21, 21 at portions thereof toward their rear ends, and are formed with disengaging wings 22, 23 extending outward from their outer sides. The engaging dogs 18, 19 have protrusions 24, 24 projecting downward from their rear ends for preventing the carrier from running by virtue of inertia. The inertial running preventing protrusions 24, 24 are spaced from the engaging projections 21, 21 by a predetermined distance and are smaller than the projections 21, 21. Each protrusion 24 has a slanting wall 24*a* on its rear side. The front ends of the engaging dogs 18, 19 beyond the pivot 20 have abutting portions 25, 25 which are in contact with the front end 12*a* of the main body 12 when the dogs 18, 19 are in suspension under gravity.

The rear free trolley 7 has an accumulating cam 26 projecting downward and extending rearward from its main body 12.

The power line P is provided by a pair of power rails 27 opposed to each other and each in the form of a channel member. Each power trolley 28 adapted to run on the power rails 27 comprises a trolley main body 29, a pair of front and a pair of rear vertical rollers 30 mounted on the front and rear ends of the main body 29, and a pusher dog 31 projecting upward from the central portion of the main body 29. The trolley main body 29 is connected by a pin 34 to one of projecting pieces 33 provided on a drive chain 32 at a predetermined spacing, rendering the pusher dog 31 of the power trolley 28 movable with the drive chain 32.

Figure 4:
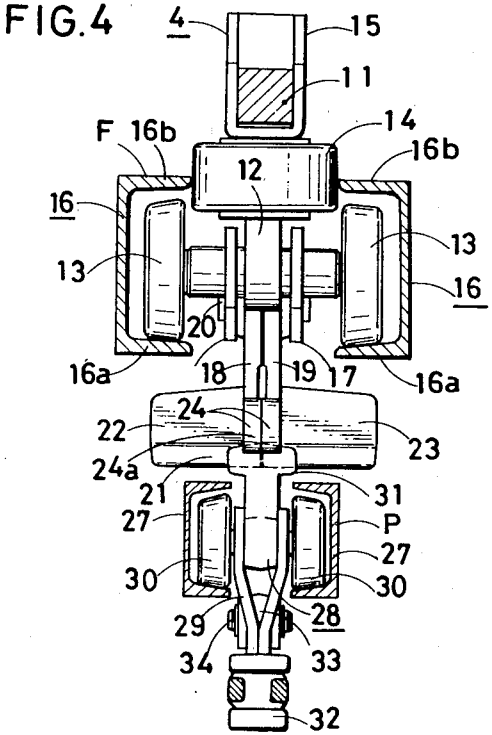
FIG. 4 is an enlarged view in section taken along the line IV—IV in FIG. 3.
Figure 3:
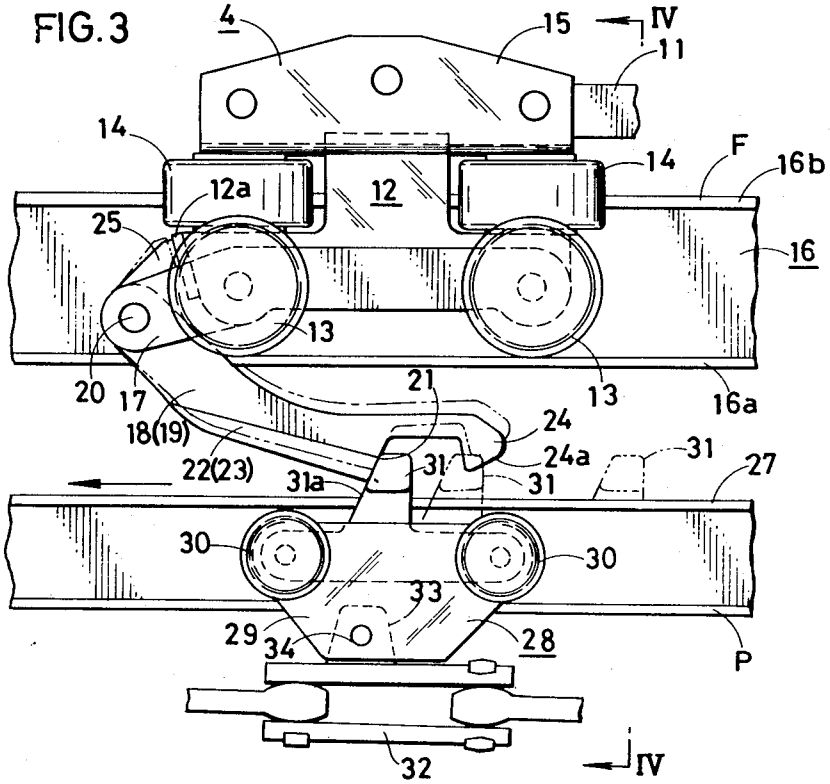
FIG. 3 is a fragmentary side elevation on an enlarged scale of FIG. 1.
Figure 5:
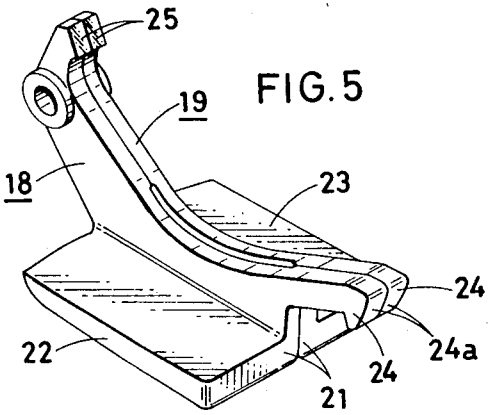
FIG. 5 is a perspective view showing engaging dogs.

When the pusher dog 31 approaches the front free trolley 4 of the carrier 3 from behind as seen in FIGS. 1 to 4, the front slanting wall 31*a* of the dog 31 comes into contact with the rear slanting walls 24*a*, 24*a* of the protrusions 24, 24 of the engaging dogs 18, 19, thereby pivotally moving the dogs 18, 19 slightly upward, with the result that the pusher dog 31 passes under the protrusions 24, 24 and comes into engagement with the engaging projections 21, 21 as seen in FIGS. 1 to 4. Consequently the carrier 3 is pulled along by the pusher dog 31. The shape of the engaging dogs 18, 19, the position of the pivot 20, etc. are determined not to permit the pivotal movement of the dogs 18, 19 while the pusher dog 31 is in engagement with the projections 21, 21. If the speed of the carrier 3 is increased abruptly by impactive contact of the pusher dog 31 with the projections 21, 21, the dog 31 is engaged by the protrusions 24, 24 positioned therebehind to prevent the carrier 3 from running under inertia. The pusher dog 31 is engageable with both the engaging dogs 18, 19 as seen in FIG. 4, or with one of the opposed dogs 18, 19 when the power line P is deviated from the free line F toward one side as will be described later.

Figure 7:
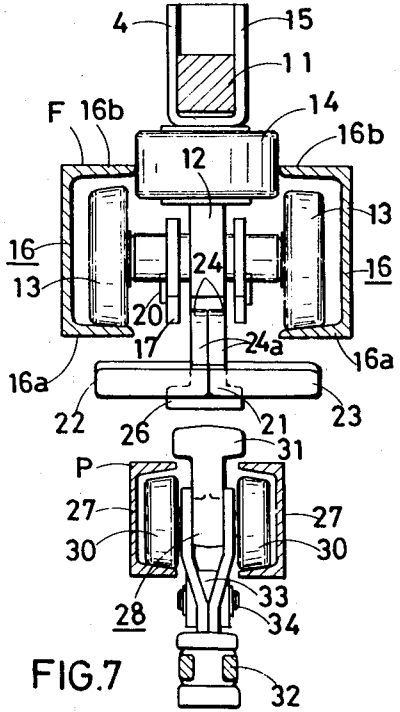
FIG. 7 is an enlarged view in section taken along the line VII—VII in FIG. 6.
Figure 6:
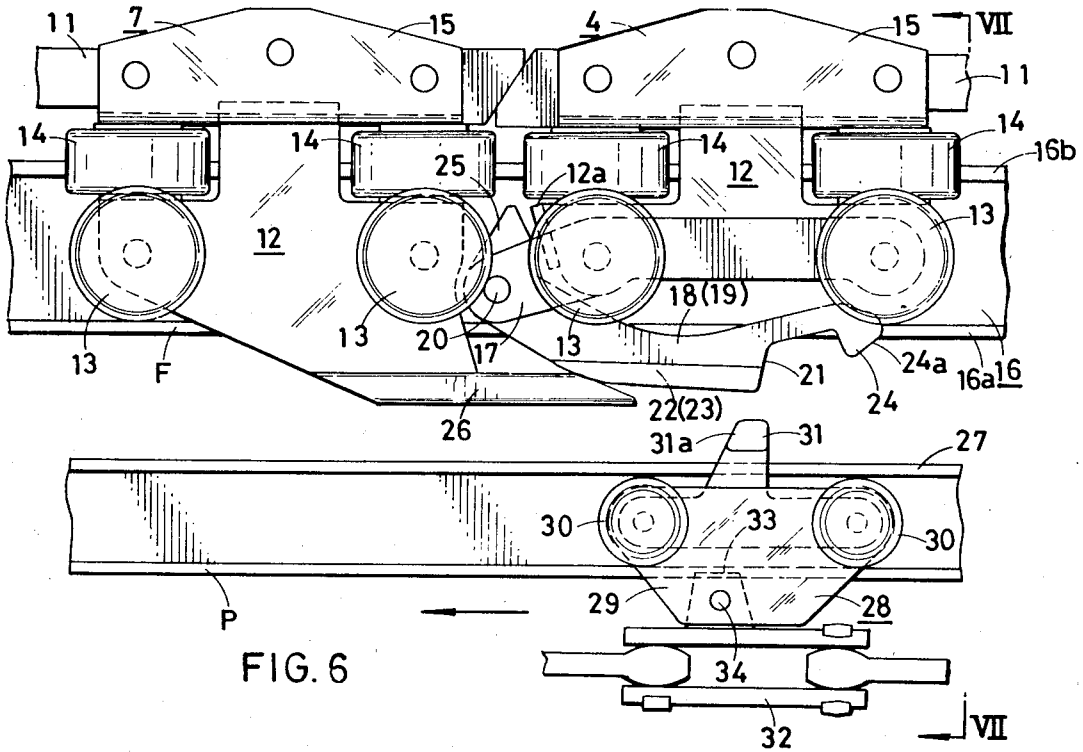
FIG. 6 is an enlarged side elevation of the conveyor to show the operation of a disengaging cam.

When a carrier 3 overtakes a preceding carrier 3 as seen in FIGS. 6 and 7, the engaging dogs 18, 19 on the front free trolley 4 of the following carrier 3 are raised by the accumulating cam 26 on the rear free trolley 7 of the preceding carrier 3 to release the pusher dog 31 from the dogs 18, 19, whereby the carriers 3 are accumulated, with the follower positioned in the rear of the preceding carrier 3.

The power-and-free trolley conveyor 2 includes apparatus for joining and diverting carriers 3 as seen in FIGS. 8 to 20.

Figure 8:
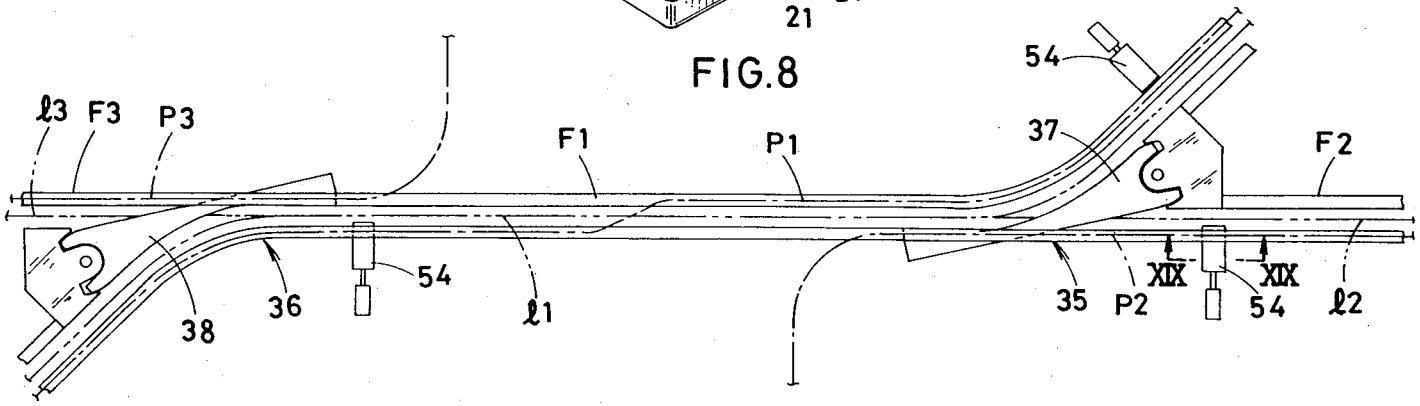
FIG. 8 is a schematic plan view showing joining and diverting apparatus.

With reference to FIG. 8 showing the apparatus for joining carriers 3, a joining free line F2, which is straight, is connected to the left side of a main free line F1 which is gently curved. At the junction 35 of the two lines F1 and F2, a main power line P1 is shifted (deviated) from the center line l1 of the main free line F1 toward the right side, and a joining power line P2 under the joining free line F2 is shifted from the center line l2 of the joining free line F2 toward the left side. The portion of the joining power line P2 extending beyond the junction 35 is greatly curved to the left away from the free line F2. The junction 35 has a joining switch 37. To the rear of the junction 35, stopper devices 54, 54 are arranged on the right side of the main free line F1 and on the left side of the joining free line F2.

In the case of the apparatus for diverting carriers 3, a straight branch line F3 is connected to the right side of the gently curved main free line F1. At the junction 36 of the two lines F1 and F3, the main power line P1 under the main free line F1 is shifted from the center line l1 of the main free line F1 toward the left side. In the vicinity of the junction 36 to the rear thereof, a branch power line P3 extending from the right side is made coextensive with the branch free line F3 thereunder. At the junction 36, the branch power line P3 is shifted from the center line l3 of the branch free line F3 toward the right side. The junction 36 of the two free lines F1 and F3 is provided with a diverting switch 38. A stopper device 54 is disposed on the left side of the main free line F1 to the rear of the junction 36.

Figure 17:
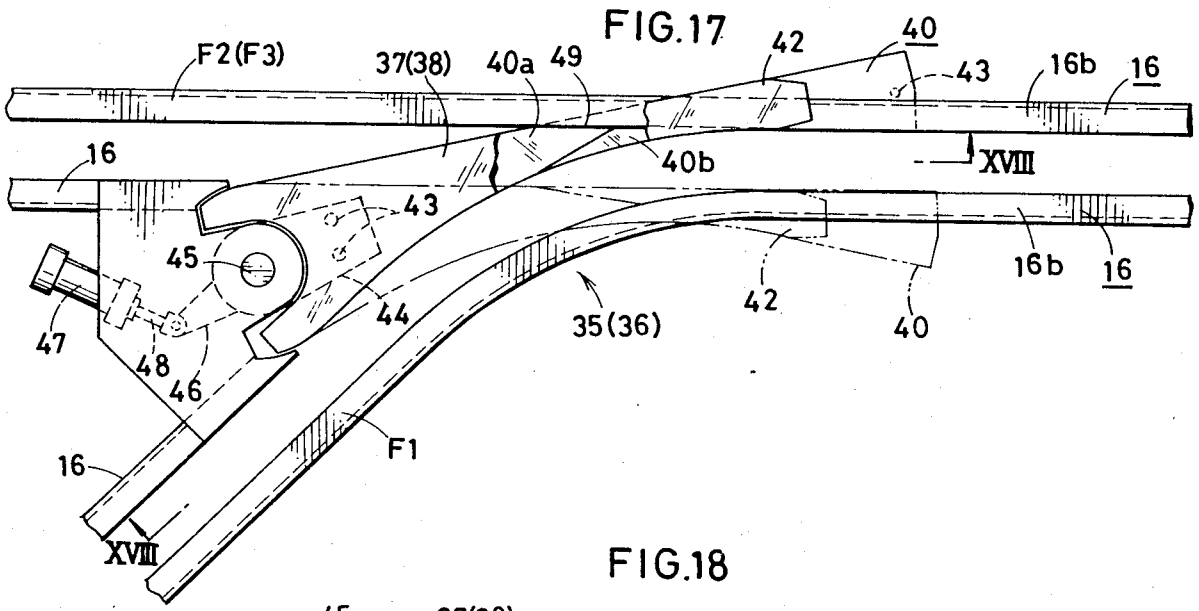
FIG. 17 is a fragmentary enlarged plan view showing a switch in detail.
Figure 18:
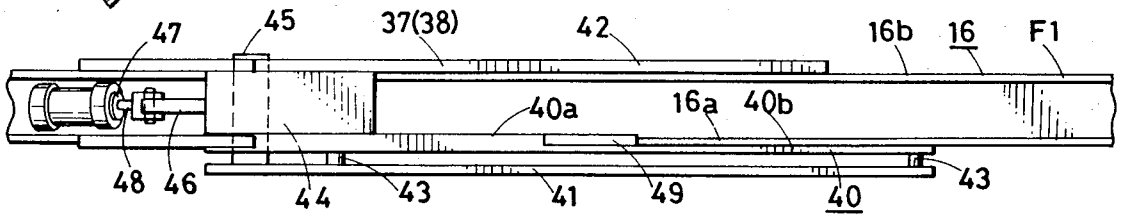
FIG. 18 is a view showing the same as it is seen along the line XVIII—XVIII in FIG. 17.

FIGS. 17 and 18 show the switches 37, 38 in detail. The joining switch 37 and the diverting switch 38 have exactly the same construction except that they are oriented in different directions.

The switch 37 (38) comprises a selection rail 40 to be selectively connected to the main free line F1 or the joining free line F2 (diverting free line F3), a disengaging plate 41 connected by pins 43 to the lower side of the selection rail 40 in parallel therewith and having the same length as the rail 40, and a horizontal roller guide plate 42 attached by a connecting plate 44 to the upper side of the selection rail 40 in parallel therewith and having a shorter length than the rail 40. The switch 37 (38) is horizontally movably supported by a pivot 45 at the junction 35 (36) of the free lines F1 and F2 (F3). The connecting plate 44 is formed at its one side with an operating lever 46. A hydraulic cylinder 47 has a piston rod 48 which is connected to the outer end of the lever 46. The switch 37 (38) is automatically operable by the projection or retraction of the piston rod 48. The selection rail 40 has at an intermediate point of its length a stepped portion 49 which is V-shaped when seen from above. The base portion 40*a* of the selection rail 40, extending from the stepped portion 49 to the pivoted portion, has an increased thickness and an upper surface which is held substantially at the same level as the upper surface of the lower horizontal wall 16*a* of the free rail 16. The remaining portion of the rail 40, i.e., its forward end portion 40*b*, has a small thickness and an upper surface which is held substantially at the same level as the lower surface of the lower horizontal wall 16*a* of the free rail 16. The lower surface of the horizontal roller guide plate is held substantially at the same level as the upper surface of the upper horizontal wall 16*b* of the free rail 16.

The discontinuous portion of the free rail 16 between the free lines F1 and F2 (F3) is interconnected by the selection rail 40 of the switch 37 (38). With reference to FIG. 17, the horizontal rollers 13 on one side of each free trolley roll on the base portion 40*a* of the selection rail 40 which portion is at the same level as the lower wall 16*a* of the free rail, approximately over the entire length of the discontinuous portion. Over the remaining small-length portion, the rolls 13 pass over the forward end portion 40*b* of the selection rail 40 which portion is at a slightly lower level.

The operation of the joining apparatus will now be described.

Figure 9:
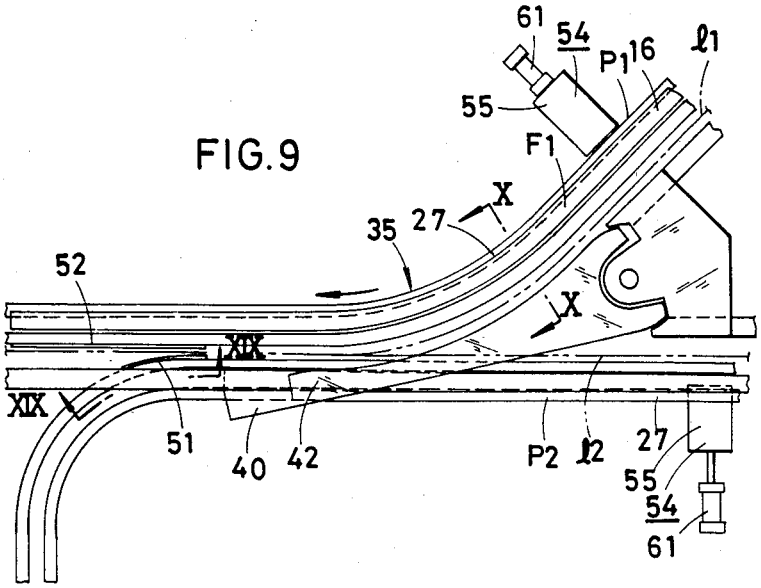
FIG. 9 is a fragmentary enlarged plan view schematically showing the joining apparatus.
Figure 10:
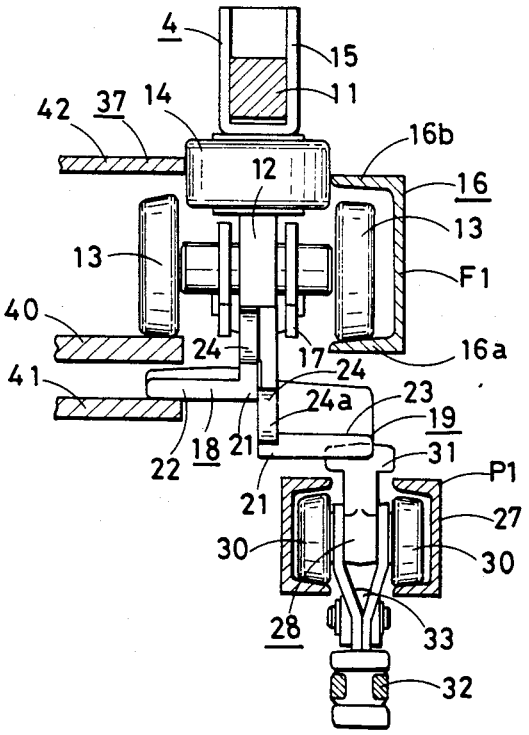
FIG. 10 is an enlarged view in section taken along the line X—X in FIG. 9.
Figure 19:
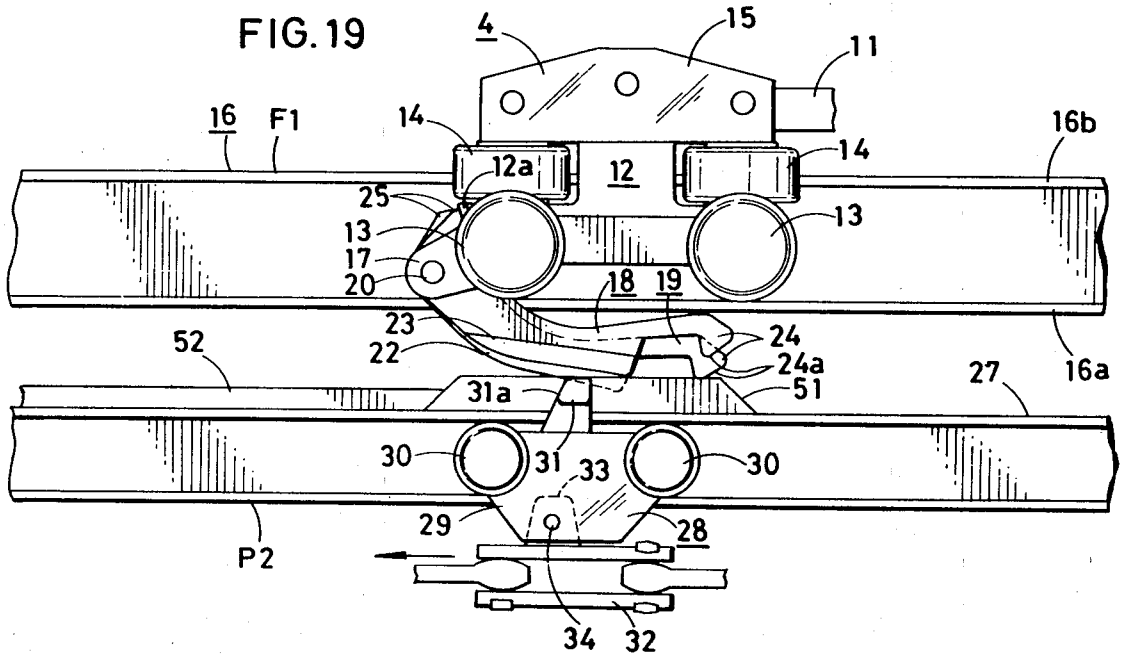
FIG. 19 is an enlarged view showing the conveyor as it is seen along the line XIX—XIX in FIG. 9.

When the carrier 3 travels along the main free line F1 over the junction, the joining swith 37 is positioned on the right side as seen in FIGS. 9 and 10. The main power line P1 is disposed as shifted from the center line l1 of the main free line F1 toward the right side, so that the pusher dog 31 on the main power line P1 is in engagement with the wing 23 of the right engaging dog 19 on the front free trolley 4 of the carrier 3 to transport the carrier 3. The other engaging dog, i.e., left dog 18, moves with its wing 22 riding on the disengaging plate 41 of the switch 37. The joining power line P2 is leftwardly shifted from the center line l2 of the joining free line F2. The left engaging dog 18, which is riding on the disengaging plate 41, is held out of engagement with the pusher dogs 31 on the joining power line P2. As shown in FIG. 19, an auxiliary rail 51 at the same level as the disengaging plate 41 is mounted on the right power rail 27 of the joining power line P2 at a location beyond the front end of the switch 37. After passing over the disengaging plate 41, the left engaging dog 18 is further held raised by the high auxiliary rail 51. At this time, the front free trolley 4 of the carrier 3 on the joining free line F2 is disengaged from the associated pusher dog 31 by the action of the stopper device 54 disposed on the left side to the rear of the free line junction 35, so that the carrier 3 is brought to a halt without entering the junction 35. The operation of the stopper device 54 will be described later.

Figure 11:
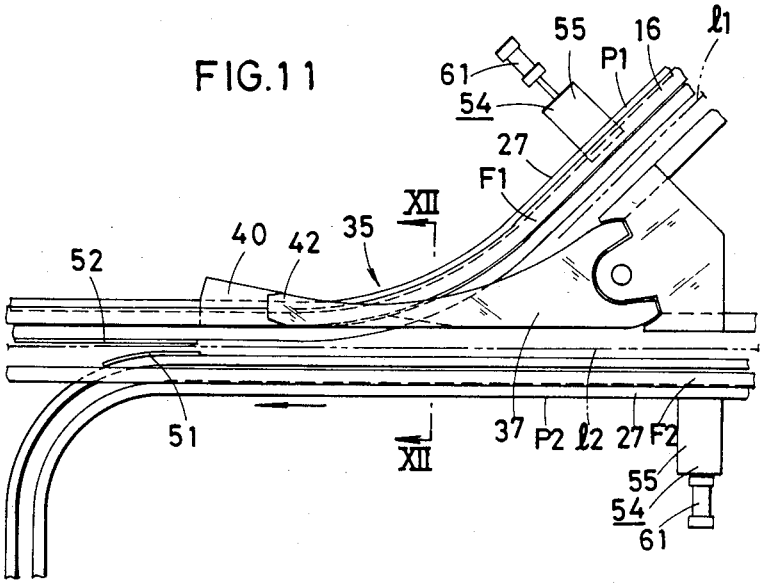
FIG. 11 is a fragmentary enlarged plan view schematically showing the joining apparatus to illustrate how a carrier is transferred to a line for joining.
Figure 12:
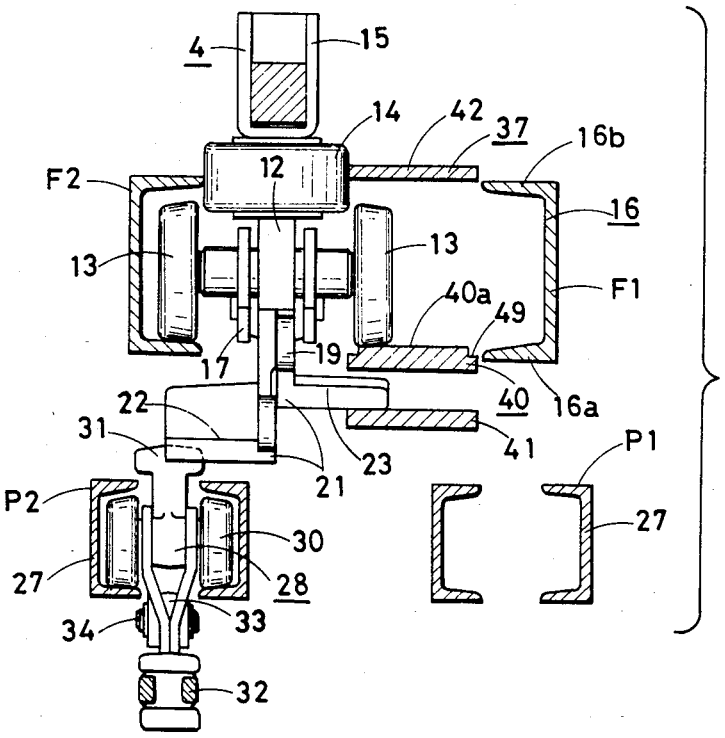
FIG. 12 is an enlarged view in section taken along the line XII—XII in FIG. 11.

The switch 37 is disposed on the right side when a carrier 3 is to be guided into the main free line F1 from the joining free line F2 as seen in FIGS. 11 and 12. At this time, the carrier 3 on the main free line F1 is held at a stop in the vicinity of the junction 35 to the rear thereof by the action of the stopper 54. A pusher dog 31 on the leftwardly shifted joining power line P2 is in engagement with the wing 22 of the left engaging dog 18 on the front free trolley 4 of the carrier 3 on the joining free line F2 to transport the carrier 3. The other engaging dog, i.e., the right dog 19, moves forward with its wing 23 riding on the disengaging plate 41 of the switch 37 and is held out of engagement with the pusher dog 31 on the main power line P1. Upon moving past the front end of the switch 37, the left engaging dog 18 rides onto the high auxiliary rail 51 and is thereby disengaged from the pusher dog 31 on the joining power line P2. Subsequently the right engaging dog 19 is transferred from the front end of the disengaging plate 41 of the switch 37 onto a relatively low auxiliary rail 52 mounted on the left power rail 27 of the main power line P1, with the result that a pusher dog 31 on the main power line P1 comes into engagement with the wing 23 of the right engaging dog 19 to further transport the carrier 3. The low auxiliary rail 52 serves to hold the right engaging dog 19 in a slightly raised position during travel. In this raised position, the lower end of the protrusion 24 of the right engaging dog 19 is substantially at the same level as the upper end of the pusher dog 31. When there is a difference in speed between the joining carrier 3 and the pusher dog 31 on the main power line P1, especially when the carrier 3 is faster, the right engaging dog 19 on the front free trolley 4 of the carrier 3 is likely to outrun the pusher dog 31. Since the right engaging dog 19 is riding on the low auxiliary rail 52 in this case, the protrusion will not engage the pusher dog 31, so that no trouble occurs. After outrunning the pusher dog 31 once, the right dog 19 spontaneously comes to a halt along with the carrier 3 by virtue of friction. The pusher dog 31 thereafter overtakes the dog 19 and engages with the dog for the transport of the carrier 3.

The operation of the diverting apparatus will now be described.

Figure 13:
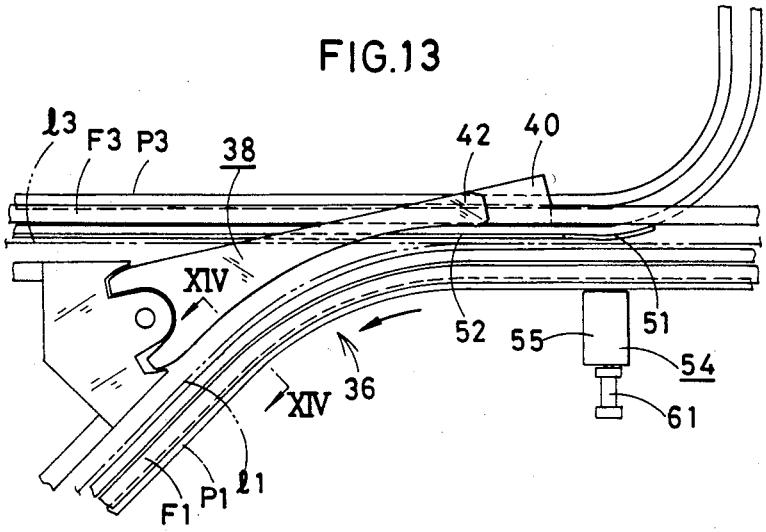
FIG. 13 is a fragmentary enlarged plan view schematically showing the diverting apparatus.
Figure 14:
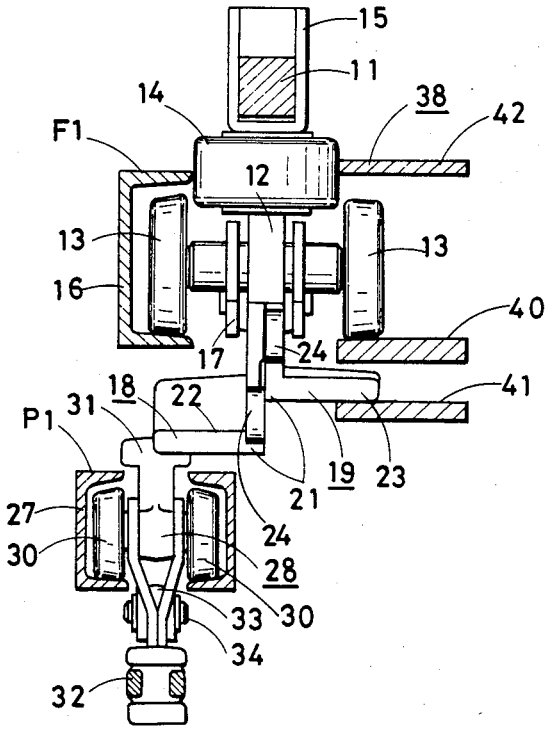
FIG. 14 is an enlarged view in section taken along the line XIV—XIV in FIG. 13.
Figure 15:
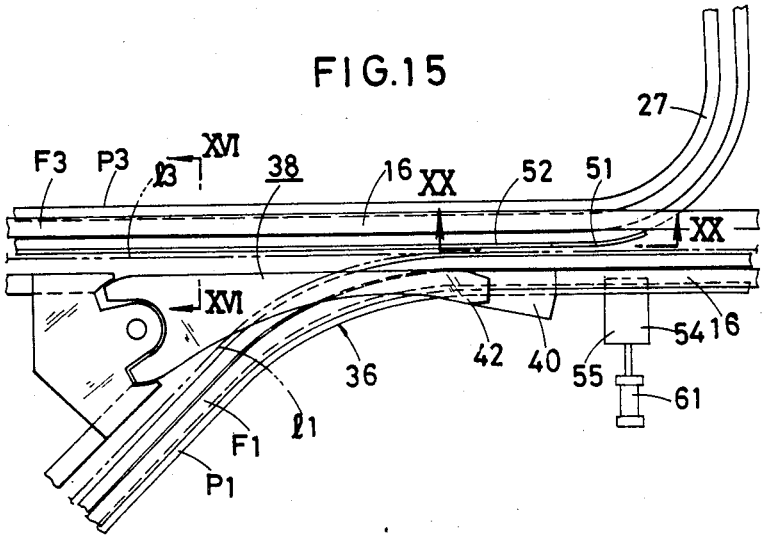
FIG. 15 is a fragmentary enlarged plan view schematically showing the diverting apparatus to illustrate how a carrier is transferred to a branch line.
Figure 16:
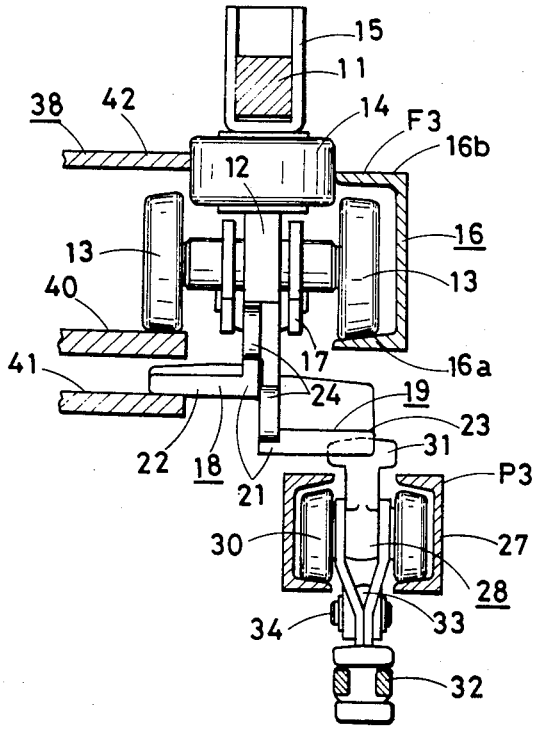
FIG. 16 is an enalrged view in section taken along the line XVI—XVI in FIG. 15.
Figure 20:
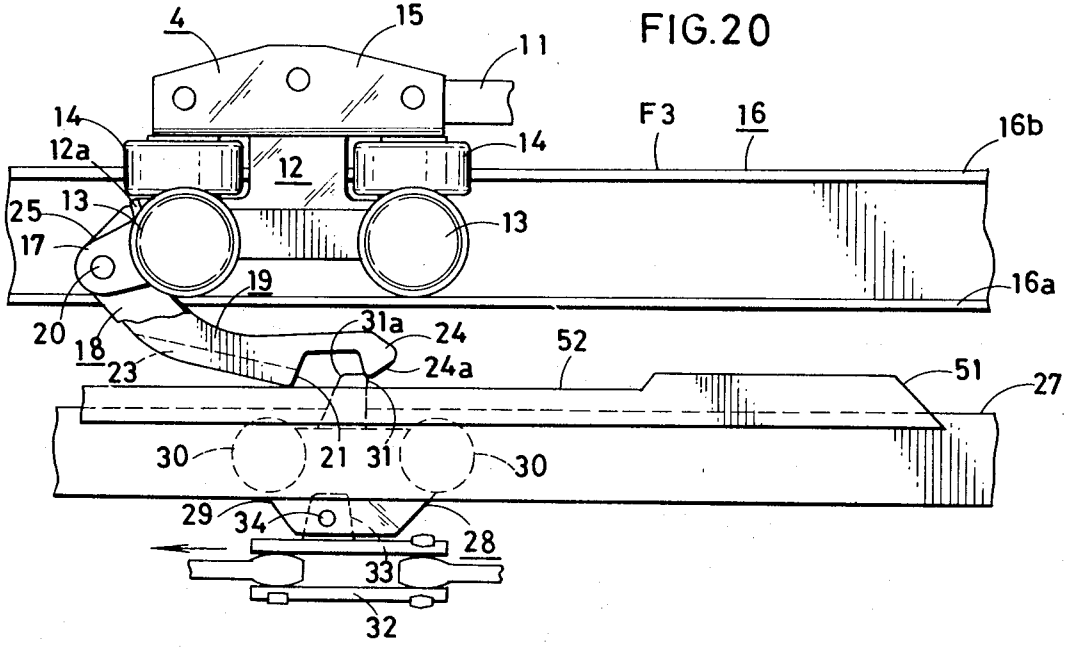
FIG. 20 is an enlarged view showing the conveyor as it is seen along the line XX—XX in FIG. 15.

When a carrier 3 travels along the main free line F1 over the junction 36, the diverting switch 38 is positioned on the right side as shown in FIGS. 13 and 14. The main power line P1 is shifted leftward from the center line l1 of the main free line F1, while the branch power line F3 is shifted rightward from the center line l3 of the branch free line F3. The carrier 3 on the main free line F1 is transported by virtue of the engagement of its left engaging dog 18 with a pusher dog 31. With reference to FIG. 20, a high auxiliary rail 51 mounted on the power rail 27 of the branch power line P3 in the vicinity of the switch 38 to the rear thereof. The right engaging dog 19 is raised by the high auxiliary rail 51 and subsequently by the disengaging plate 41 of the switch 38 and is thereby held out of engagement with the pusher dog 31 on the branch power line P3. When the carrier 3 is to be led onto the branch line F3 from the main free line F1, the diverting switch 38 is disposed on the left side as seen in FIGS. 15 and 16. The carrier 3 travelling forward on the main free line F1 has its left engaging dog 18 disengaged from the pusher dog 31 concerned of the main power line P1 by the wing 22 thereof riding onto the disengaging plate 41 of the switch 38. On the other hand, the right engaging dog 19 rides onto the high auxiliary rail 51 near the rear end of the switch 38 and is prevented from sidewise striking contact with the pusher dog 31 on the branch power line P3. The right engaging dog 19 thereafter rides onto a lower rail 52 on the left power rail 27 and comes into engagement with the pusher dog 31 on the branch power line P3, whereby the carrier 3 is transferred onto the branch free line F3. As in the foregoing case, the low auxiliary rail 52 is provided to avoid the trouble that could result if there is a difference in speed between the carrier 3 sent out from the main free line F1 and the pusher dog 31 on the branch power line P3. The stopper device 54 provided on the left side of the main free line F1 close to the rear end of the switch 38 is adapted to hold the carrier 3 on the line F1 at a stop while the switch 38 is changed over.

At an intermediate location between the joining apparatus and the diverting apparatus, the main power line P1 is shifted from the right side of the center line l1 of the main free line F1 to the left side thereof. At this location, the pusher dog 31 in engagement with the projection 21 of the right engaging dog 19 of the carrier 3 merely comes into engagement with the projection 21 of the left engaging dog 18 while sliding laterally, permitting the carrier 3 to run along without any trouble.

Figure 21:
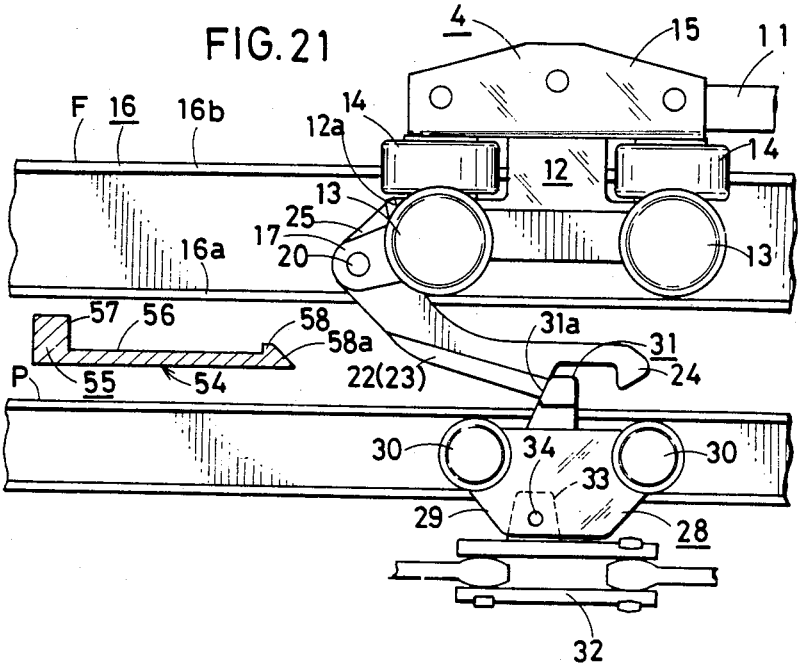
FIG. 21 is an enlarged view in section taken along the line XXI—XXI in FIG. 8 and showing the engaging dog before it is engaged by a stopper.
Figure 22:
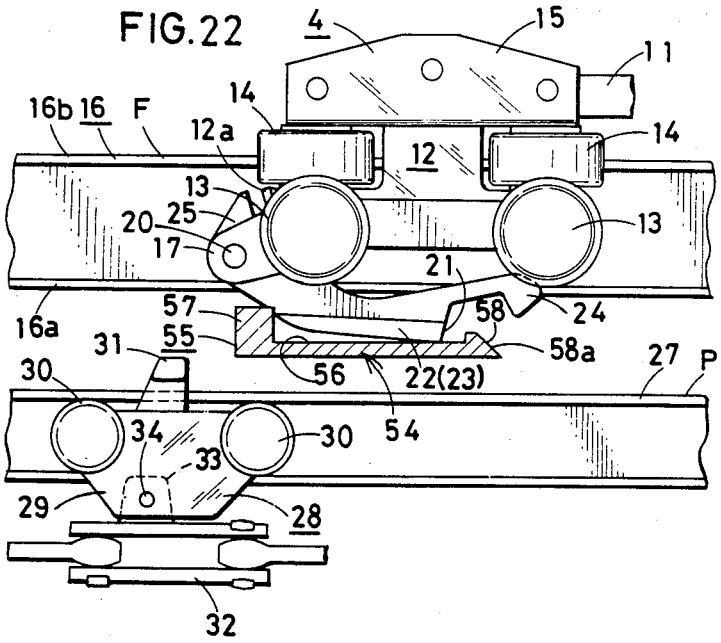
FIG. 22 is a sectional view similar to FIG. 21 and showing the engaging dog as engaged by the stopper.
Figure 23:
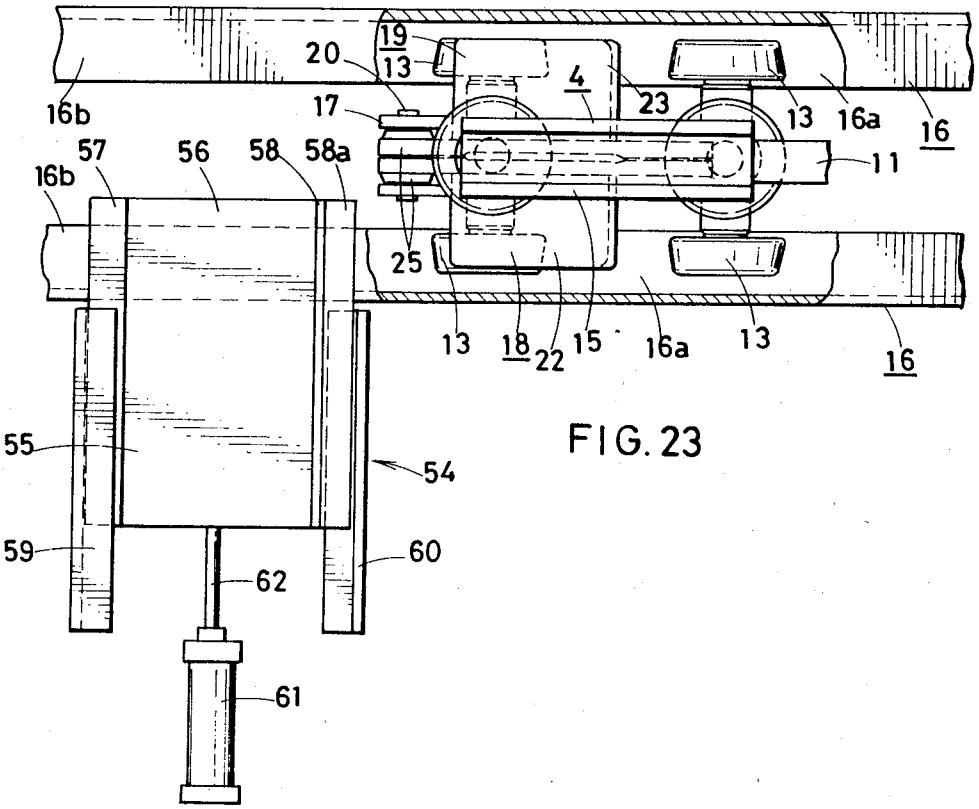
FIG. 23 is a fragmentary enlarged plan view corresponding to FIG. 21.

FIGS. 21 to 23 show the stopper device 54 in detail. The stopper device 54 comprises a stopper 55 movable into and out of the path of movement of the wings 22, 23 of the engaging dogs 18, 19 and supported at a higher level than the pusher dog 31. The stopper 55 is in the form of a plate and includes a disengaging portion 56 for holding the wings 22, 23 in a raised position, a high projection 57 for holding the wings 22, 23 at the front end of the portion 56, and a low projection 58 for preventing return of the wings 22, 23 at the rear end of the portion 56. The return preventing projection 58 is formed with a guide wall 58*a* slanting rearwardly downward. The stopper 55 is slidingly guided by a front guide 59 in the form of a channel and a rear guide 60 L-shaped in cross section. The stopper 55 is movable toward and away from the free line F at right angles thereto by the movement of the piston rod 62 of a hydraulic cylinder 61.

When the stopper 55 is in its advanced position with its front end positioned in the path of movement of the wings 22, 23 of the engaging dogs 18, 19 of the front free trolley 4 as shown in FIGS. 21 and 23, the wings 22, 23 of the dogs 18, 19 travelling with the trolley 4 ride onto the disengaging portion 56 of the stopper 55 by being guided by the slanting wall 58*a* of the stopper 55, whereby the projections 21, 21 of the dogs 18, 19 are disengaged from the pusher dog 31, whereupon the front edges of the wings 22, 23 strike against the holding projection 57 of the stopper 55 as seen in FIG. 22. Thus, the engaging dogs 18, 19, the front free trolley 4 carrying these dogs and, accordingly, the carrier 3 are stopped at the position of the stopper. Even if the impact of the contact between the dogs 18, 19 and the stopper 55 acts to reversely move the carrier 3, the rear edges of the wings 22, 23 of the dogs 18, 19 engage the return preventing projection 58 at the rear end of the stopper 55 to prevent the carrier 3 from moving backward.

The present invention may be embodied differently without departing from the spirit and basic features of the invention. Accordingly the embodiment herein disclosed is given for illustrative purposes only and is in no way limitative. It is to be understood that the scope of the invention is defined by the appended claims rather than by the specification and that various alterations and modifications within the definition and scope of the claims are included in the claims.

What is claimed is:

1. A power-and-free trolley conveyor of the floor type comprising carriers adapted to run on a free line and each including a free trolley, the free trolley being provided with a pair of right and left pivotable engaging dogs respectively having downwardly projecting engaging projections and disengaging wings, the wings projecting rightward and leftward respectively, power trolleys adapted to run on a power line extending under the free line, each of the power trolleys having a pusher dog engageable with the engaging projection of at least one of the engaging dogs and means for engaging the projecting wing on one of said pair of said engaging dogs for pivoting said one dog out of the path of engagement of said pusher dog on said power trolley while the other dog of said pair of engaging dogs remains engaged with said pusher dog.

2. A joining apparatus in a power-and-free trolley conveyor of the floor type comprising carriers adapted to run on a main free line and a joining free line connected thereto, each of the carriers including a free trolley provided with a pair of right and left pivotable engaging dogs, the engaging dogs respectively having downwardly projecting engaging projections and rightwardly and leftwardly projecting disengaging wings, power trolleys adapted to run on a main power line and a joining power line arranged under the main free line and the joining free line respectively, each of the power trolleys having a pusher dog engageable with the engaging projection of at least one of the engaging dogs on the free trolley, and a switch disposed at the junction of the main free line and the joining free line, the switch including a selection rail horizontally movable pivotally and selectively connectable to the main free line or the joining free line and a disengaging plate disposed under the selection rail for holding one of the engaging dogs in a raised position by causing the wing thereof to ride on the plate, the main power line being deviated from the center line of the main free line toward one side at the junction, the joining power line being deviated from the center line of the joining free line toward the other side at the junction, the free trolley being adapted to pass the free line junction by one of the engaging dogs of the free trolley on the main free line or on the joining free line being raised by the disengaging plate of the switch and the other engaging dog being engaged by a pusher dog on the main power line or on the joining power line, with the selection rail of the switch selectively connected to the main free line or to the joining free line.

3. A diverting apparatus in a power-and-free trolley conveyor of the floor type comprising carriers adapted to run on a main free line and a branch free line connected thereto, each of the carriers including a free trolley provided with a pair of right and left pivotable engaging dogs, the engaging dogs respectively having downwardly projecting engaging projections and rightwardly and leftwardly projecting disengaging wings, power trolleys adapted to run on a main power line and a branch power line arranged under the main free line and the branch free line respectively, each of the power trolleys having a pusher dog engageable with the engaging projection of at least one of the engaging dogs on the free trolley, and a switch disposed at the junction of the main free line and the branch free line, the switch including a selection rail horizontally movable pivotally and selectively connectable to the main free line or the branch free line and a disengaging plate disposed under the selection rail for holding one of the engaging dogs in a raised position by causing the wing thereof to ride on the plate, the main power line being deviated from the center line of the main free line toward one side at the junction, the branch power line being deviated from the center line of the branch free line toward the other side at the junction, the free trolley being adapted to pass the free line junction by one of the engaging dogs of the free trolley on the main free line or on the branch free line being raised by the disengaging plate of the switch and the other engaging dog being engaged by a pusher dog on the main power line or on the branch power line, with the selection rail of the switch selectively connected to the main free line or to the branch free line.

4. In a power-and-free trolley conveyor of the floor type comprising carriers adapted to run on a free line and each including a free trolley, the free trolley being provided with a pair of right and left pivotable engaging dogs respectively having downwardly projecting engaging projection and disengaging wings, the wings projecting rightward and leftward respectively, power trolleys adapted to run on a power line extending under the free line, each of the power trolleys having a pusher dog engageable with the engaging projection of at least one of the engaging dogs, means for engaging the projecting wing on one dog of said pair of engaging dogs for pivoting said one dog on said free trolley out of the path of engagement of said pusher dog on said power trolleys while the other dog of said pair of dogs remains engaged with said pusher dog, apparatus for stopping the carrier comprising a stopper disposed on at least one of the right and left sides of the free line and movable into and out of the path of movement of the wings of the engaging dogs, the stopper being retained at a higher level than the pusher dog and having a disengaging portion for holding the wings of the engaging dogs at a raised position and a wing holding projection at the front end of the disengaging portion.

* * * * *